US005679161A

United States Patent [19]

Wysokowski et al.

[11] Patent Number: 5,679,161

[45] Date of Patent: Oct. 21, 1997

[54] PRECISION CENTER GUIDING OF A WEB COATED WITH LIGHT SENSITIVE PHOTOGRAPHIC EMULSION

[75] Inventors: John Philip Wysokowski, Fairport; Ernest A. Graff, Ontario; Robert Lewis Walton, Fairport; Mark D. Abbey; Kevin Peter Deuel, both of Rochester, all of N.Y.

[73] Assignee: Eastman Kodak Company, Rochester, N.Y.

[21] Appl. No.: 569,311

[22] Filed: Dec. 8, 1995

Related U.S. Application Data

[63] Continuation of Ser. No. 251,804, May 31, 1994, abandoned.

[51] Int. Cl.[6] ..... B05C 11/00

[52] U.S. Cl. ..... 118/669; 118/673; 118/688; 118/708; 118/712

[58] Field of Search ..... 118/669, 673, 118/679, 688, 708, 712

[56] References Cited

U.S. PATENT DOCUMENTS

| | | | |
|---|---|---|---|
| 2,521,953 | 9/1950 | Tuttle . | |
| 4,021,832 | 5/1977 | Krehbiel et al. | 354/298 |
| 4,134,663 | 1/1979 | Laar et al. | 354/321 |
| 4,189,335 | 2/1980 | Evans et al. | 154/64 |
| 4,291,825 | 9/1981 | Glanz | 226/18 |
| 4,346,668 | 8/1982 | Pöhler et al. | 118/665 |
| 4,357,899 | 11/1982 | Jones et al. | 118/665 |
| 4,760,945 | 8/1988 | Zerle | 226/18 |
| 4,804,996 | 2/1989 | Snelling | 118/688 |
| 4,865,872 | 9/1989 | Pellatiro | 118/669 |
| 4,896,807 | 1/1990 | Mundschau | 226/21 |
| 4,957,770 | 9/1990 | Howarth | 118/688 |
| 5,018,888 | 5/1991 | Nishimura et al. | 400/616.1 |
| 5,087,313 | 2/1992 | Duecker | 156/271 |
| 5,119,981 | 6/1992 | Gneuchtel et al. | 226/15 |
| 5,162,131 | 11/1992 | Rantanen et al. | 118/712 |
| 5,206,771 | 4/1993 | Katou et al. | 360/71 |
| 5,276,503 | 1/1994 | Hayashi et al. | 118/712 |
| 5,338,361 | 8/1994 | Anderson et al. | 118/688 |
| 5,582,646 | 12/1996 | Woollam et al. | 118/708 |

OTHER PUBLICATIONS

*Bulletin 5370; CVIM2™; Configurable Vision Input Module User's Manual*; Cat. #5370 (CVIM)–ND001 Series B (1990–no month) Allen–Bradley Co. excupt—Chapter 7.

Paul Tipler, *Physics*, Worth Publishers, Inc 1976 (no month) excerpt pp. 594–599 and 612–614.

*Primary Examiner*—Marianne Padgett

*Attorney, Agent, or Firm*—Clyde E. Bailey, Sr.; Carl F. Ruoff

[57] ABSTRACT

An apparatus and method for detecting the edge of a light sensitive photographic emulsion on a support is described. The method and apparatus include a pair of collimated infrared light sources for illuminating each edge of the support at an angle of incidence of greater than 0° to about 45°. Positioned above the edges of the support are a pair of CCD cameras. Light scattered by the support and emulsion is detected by the CCD cameras and the edges of the emulsion and the edges of the support are detectable. Signal means are used to generate a signal corresponding to the position of the emulsion on the support. A conventional guider receives the signal and positions the support accordingly.

8 Claims, 3 Drawing Sheets

PRECISION CENTER GUIDING OF A WEB COATED WITH LIGHT SENSITIVE PHOTOGRAPHIC EMULSION

This is a continuation of U.S. application Ser. No. 251,804, Filed 31 May 1994 now abandoned.

FIELD OF THE INVENTION

The present invention relates generally to a web guide apparatus that corrects lateral displacements of a traveling web. More particularly, the present invention provides an apparatus that can detect the edges of the web and the light sensitive photographic emulsion coated thereon.

BACKGROUND OF THE INVENTION

A typical web guide system can be considered as a feed-forward type of controller. The location of the web edge sensor is relatively close to the guider. As the web passes the edge sensor, any variations from a desired location are detected by the edge sensor and the position is corrected for by the guider. This type of control scheme can be very responsive and effective at correcting lateral web position offsets immediately following the guider. However, as the web moves away from the guider, various lateral forces can cause the web to track to a different position or weave side-to-side. When precise lateral positioning is required at a downstream location, for example a coating station, unacceptable registration variability results, regardless of the guider's performance. This can be due to physical limitations that prevent the guider from being closer to the coating station.

The degree to which a web will move off center depends on many factors, including roller alignment and deflection, and the shape of the web. For some manufacturing operations, the amount of lateral track off is negligible, thus most guiders perform quite adequately for their intended purpose.

There is however, a growing need within photographic manufacturing operations, to maintain very accurately, the lateral position of the light sensitive photographic material so that it is centered onto the web. At all of the coating operations, one or more guiders are located upstream of the coating station. The distance between the coating station and the last upstream guider varies with each coating machine. As the web leaves the guider and travels toward the coating station, it will move off machine center by some nominal amount and may also weave side-to-side. The coating application location can also vary relative to machine centerline as there is lateral placement variability of the coating hopper at the coating station.

Because the photographic emulsions are sensitive to visible light (i.e., rendered useless if exposed), the coating operation is performed in total darkness. Thus, during normal coating operations, the location of the edge of the emulsion cannot be seen by an operator, and the location of the edge is difficult to detect. Because most photographic emulsions are not sensitive to wavelengths in the near infrared (IR), numerous attempts have been made to detect the location of the edge of the emulsion using various IR illumination sources. However, these attempts have not been completely successful. When the edge of the web is illuminated from above with a diffused IR light source and the web is viewed with a line-scan camera or a 512×512 CCD (charge coupled device), on some grades of products, there is no distinguishable difference between the support and the emulsion. Attempts have also been tried with specular reflection. Again the results have not been completely successful. Compounding this problem is the fact that the paper support is typically coated with polyethylene. This polyethylene is coated wider than the paper support. The paper support is then slit to various desired widths depending on product type, prior to the emulsion coating operation. Hence, the coating station receives rolls of paper support web with a polyethylene overcoat on both edges, or on one edge only, or with no polyethylene overcoat. Thus, a successful measurement system must discriminate between the edge of the support and the edge of the emulsion, both of which vary for each product.

The present invention is a method and apparatus which can detect the edge of emulsion coating on a support and the edge of the support, and continuously center the emulsion on the support. The support can be paper, polyethylene coated paper, acetate and polyethylene terephthalate.

SUMMARY OF THE INVENTION

The present invention is an apparatus for detecting a light sensitive photographic emulsion on a support and includes two collimated infrared light sources for illuminating each edge of the support at an angle of incidence of greater than 0° to about 45°. The apparatus includes two CCD cameras positioned above each edge of the support wherein light scattered by the support and emulsion is detected by the CCD cameras whereby both edges of the light-sensitive photographic emulsion are detectable. The apparatus also includes a means for generating a signal corresponding to the location of the emulsion edges. This signal is sent to a guider to control the lateral position of the support thereby maintaining the emulsion centered on the support.

The present invention also includes the method of using the apparatus.

For a better understanding of the present invention, together with other and further objects, advantages and capabilities thereof, reference is made to the following detailed description and appended claims in connection with the preceding drawings and description of some aspects of the invention.

DETAILED DESCRIPTION OF THE PREFERRED EMBODIMENT

Figure 1:
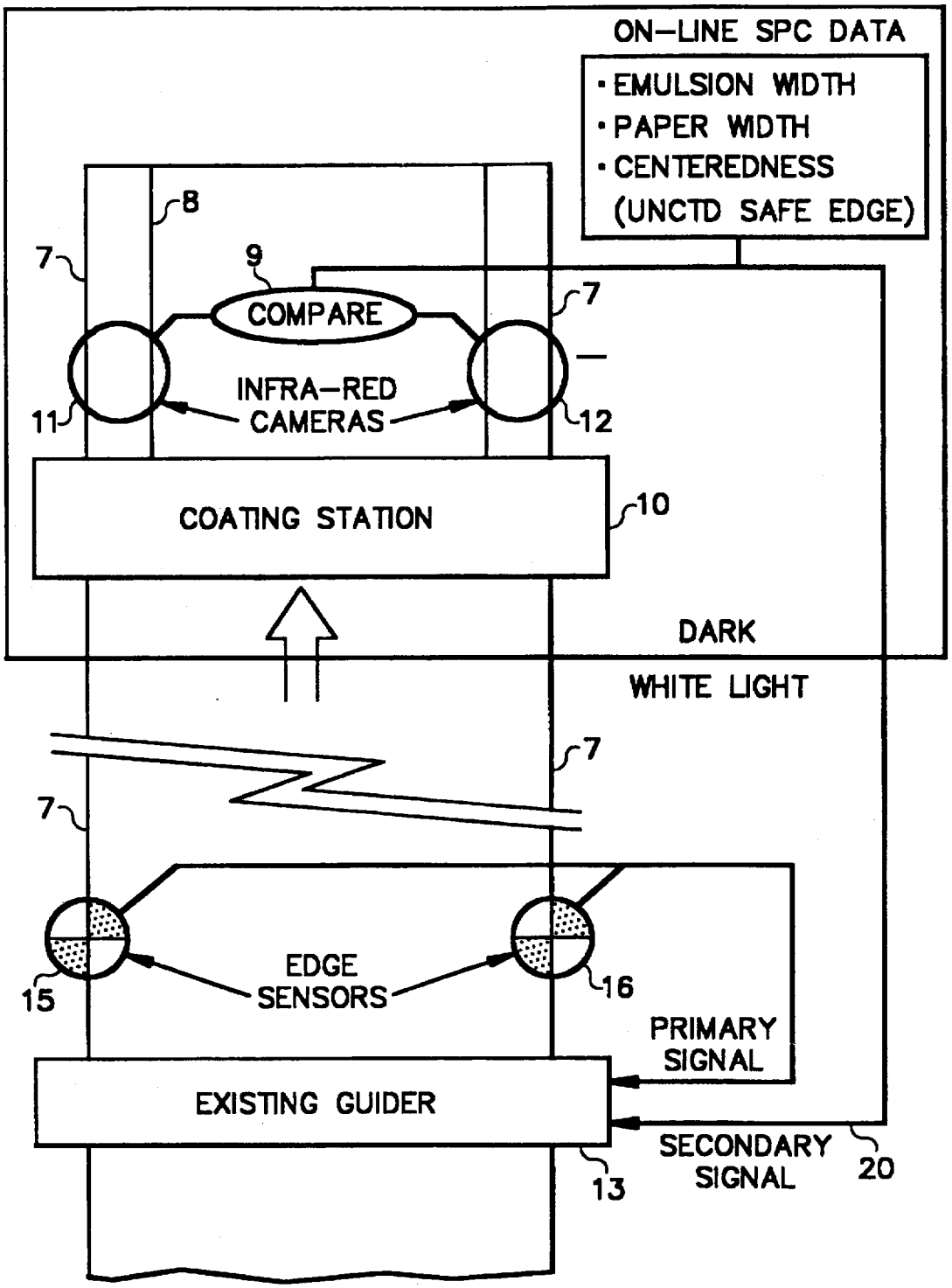
FIG. 1 shows a schematic diagram of the present invention used with an existing guider.

The present invention is an apparatus and method that allows one to keep emulsion laterally centered on a web, e.g., paper support. The apparatus uses a combined feedback-feedforward control scheme, commonly referred to as a master-slave control. The invention gives the ability to easily compensate for small lateral placement changes of coating hoppers and lateral web tracking errors, while maintaining rapid response to the feedforward control of a typical guider. Shown in FIG. 1 is a schematic diagram of an existing guider used with a detection system of the present invention. The web travels in the direction of the arrow. Immediately after the coating station 10, a pair of cameras 6 (not shown in FIG. 1) and collimated infrared light sources are installed to illuminate both edges of the support at locations 11 and 12. Each camera 6 images the support edge and an image processor 9 (e.g., Allen Bradley CVIM) calculates and compares the lateral distance from the support edge to the emulsion edge on each side of the web and sends the error signal to the existing guider 13. This is a secondary signal 20 sent to the existing guider. The primary signal is determined from sensors 15 and 16 (See U.S. Pat. Nos. 4,760,945 and 5,119,981) which generate a signal prior to the coating station 10. These sensors can use visible light as there is no emulsion on the support at this point.

Figure 2:
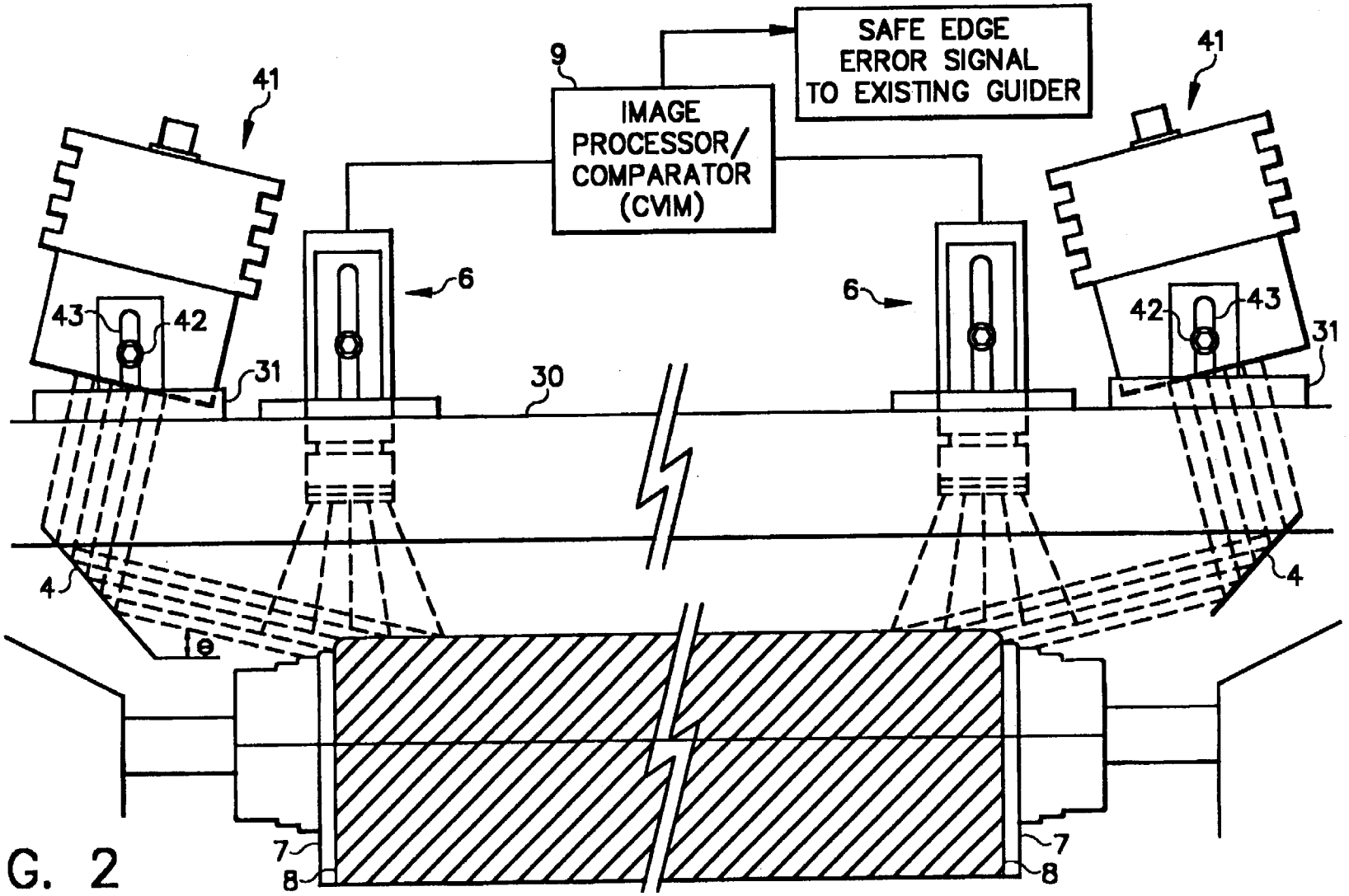
FIG. 2 shows the position of the cameras and light sources in relation to the emulsion-coated support.
Figure 3:
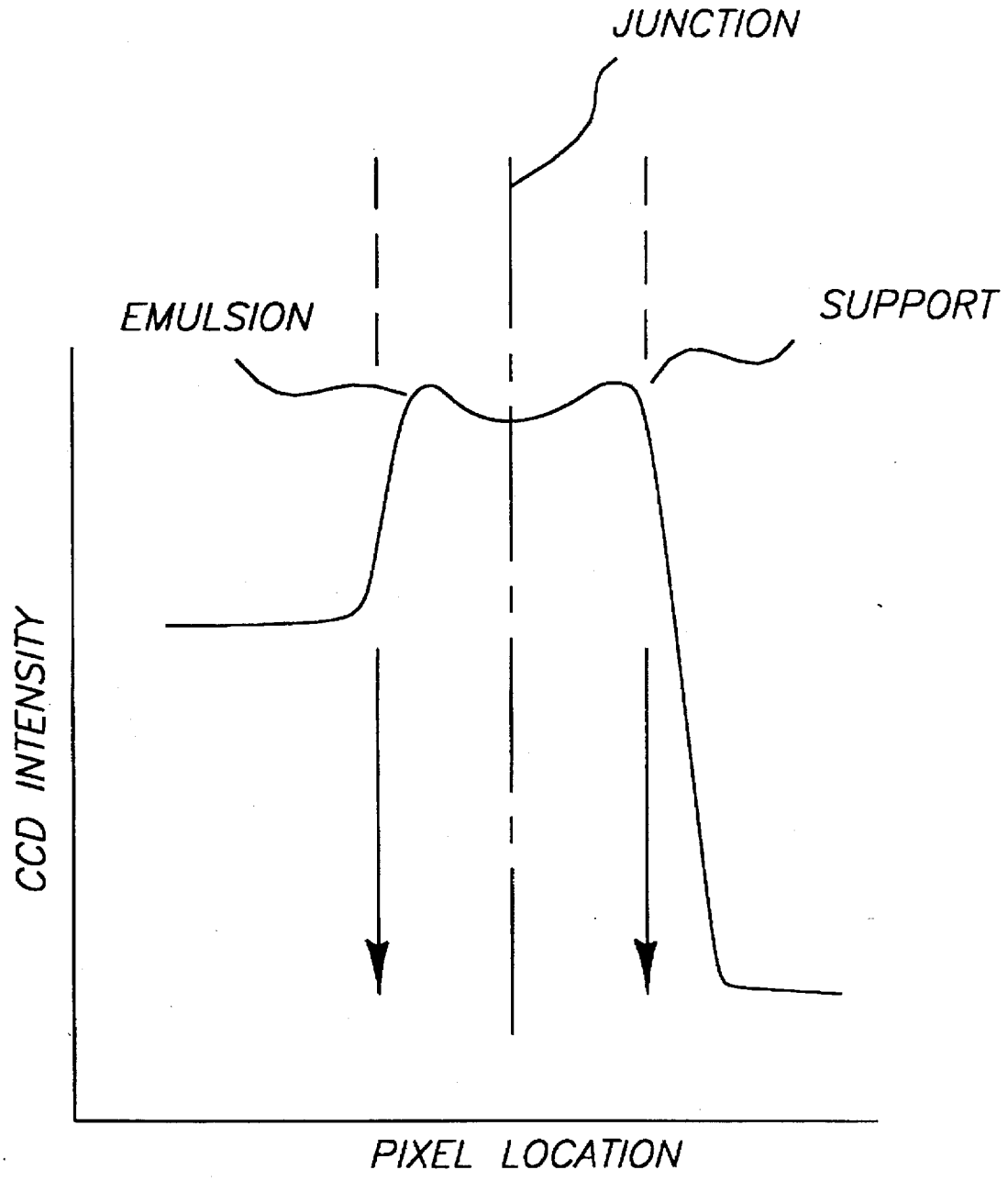
FIG. 3 shows a typical signal intensity curve from the CCD that corresponds to the support and the nearest adjacent edge of the emulsion.

Shown in FIG. 2 is a detailed view of the collimated IR light sources 41 and cameras 6 used to illuminate the edges 7 of the support and the edges 8 of the emulsion. There are two things that are critical to this illumination. First is that the light source is collimated. Although illuminating the web at a low angle of incidence with a nonstructured IR light source allows one to occasionally view the edges 8 of the emulsion with a CCD camera, a collimated light source gives the best definition of the edges 8 of the emulsion for all grades of product. The second critical factor is that the illumination is at a low angle of incidence from the outside of the edges 7 of the support towards the center of the support. In FIG. 2, mirrors 4 are used to fold the light sources 41 to compensate for the limited space at the edges 7 of the support. The edges 7 of the support are then viewed with cameras 6 that are sensitive in the IR range. There are many manufacturers of line-scan cameras (e.g., I2S, EG&G, Fairchild Weston) and two-dimensional array cameras (e.g., EG&G, Fairchild Weston, Pulnix, Kodak). Pulnix cameras were selected for their superior performance in the near infrared range. Using various machine vision processing techniques (e.g., CVIM linear gauging) the edge 7 of the polyethylene coated support and edge 8 of the emulsion are detected and measured on both sides of the web. The pattern of light energy scattered by the edge 8 of the emulsion must be sufficiently intense and consistent for a commercially available image processor to convert to a lateral position, as described below. According to FIG. 3, the intensity signal from a CCD camera 11, 12 is illustrated. The nearly vertical transitions are what the image processor 9 of the invention responds to in measuring the distance between the edge 8 of the emulsion and the edge 7 of the support, as shown in FIGS. 1 and 2. The processor 9 is programmed to scan from right to left across the support and to interpret the first transition as the support edge 7 and the second transition as the nearest adjacent edge 8 of the emulsion. Two pixel locations are defined and the known pixel size (as determined by the CCD camera 11, 12) determines the lateral distance between the edge 7 of the support and the edge 8 of the light sensitive photographic emulsion. Thus skilled artisans will appreciate that the CVIM linear gauging device of the invention operates by generating an output signal having a first amplitude corresponding to the support and a second amplitude corresponding to the emulsion. The respective amplitudes are separated by a juncture or transition which defines the nearest adjacent edge 8 of the emulsion on the support. The difference between the edge 7 of the support and the edge 8 of the emulsion is then computed for each side and compared to each other. An error signal 20 (See FIG. 1) is then generated and used to adjust the setpoint of the upstream commercially available guider, such as that described in U.S. Pat. No. 4,760,945.

FIG. 2 shows the collimated IR light sources 41 mounted on a frame 30. The angle and location of the illumination can be adjusted using pivot points 42 and adjustment slots 43 located on the mounting brackets 31 attached to the frame 30. The collimated beam is folded by a mirror 4. The need for the mirror in the present application is strictly due to space limitations and does not add any unique feature to the measurement. If space considerations are not an issue, the light source 41 can be mounted in such a position that it illuminates the web at a low angle of incidence directly. A small angle of illumination $\theta$ is critical to the measurement. The optimum angle will change with location and product. It is preferred that an angle between 0° and 20° be used but the present invention will work with larger angles (0°–45°). The most preferable angle is approximately 5°. The area illuminated by the light source is controlled by the width of the beam and the angle $\theta$. The width is optimized for each coating machine. The edge 7 of the support and the edge 8 of the emulsion are then viewed with a 512×512 CCD camera 6 that is sensitive in the IR range (such as a Pulnix 545).

The video images are then processed using a commercially available vision processing system such as the Allen Bradley CVIM8. The distances between the edge 8 of the emulsion and the edge 7 of the support on each edge are calculated and compared. If there is a difference between the edge 8 of the emulsion and the edge 7 of the support for each side, an error signal 20 is generated and sent to the upstream guider 13 as an offset to the setpoint of the guider. This causes the upstream guider to adjust the lateral position of the support, thereby centering the support under the emulsion. The ability of guider 13 to accept signal 20 is a commercially available feature utilized by this invention.

The present invention allows on-line calibration of the cameras. Two marks are placed on each edge of the roller that are a measured distance apart. When the web passes under the CCD camera, the camera is calibrated by counting the number of pixels between the marks. This can be done by the microprocessor. After calibration, the distance between the edges 7 of the support and the distance between the edges 8 of the emulsion can also be determined. These full width dimensions are important in determining the absolute position of the web centerline. Since it is known that the full width of the web varies somewhat, an exact determination of the variation in full width can be determined. Likewise, the variation in the full width of the emulsion can also be determined.

The present invention is used on different textured supports. These supports can by polyethylene coated or uncoated. The finish can be glossy or matte. The present invention is capable of detecting the edge 7 of the support and the edge 8 of the emulsion in each of these situations.

Although there has been shown and described what are at present considered the preferred embodiments of the invention, it will be obvious to those skilled in the art that various changes, alterations and modifications may be made therein without departing from the scope of the invention as defined by the appended claims.

What is claimed is:

1. An apparatus for detecting a light-sensitive photographic emulsion on a support in the absence of visible light, an edge of said emulsion being exposed on said support, said apparatus comprising;

a collimated infrared light source for illuminating the support and a nearest adjacent edge of said emulsion on said support, wherein light waves emitted by said light source have a predetermined angle of inclination with a plane of the support less than about 20 degrees;

a charge coupled device camera positioned above said support, said charge coupled device camera having a field of view including said nearest adjacent edge of said light-sensitive photographic emulsion;

wherein light scattered by the support and said nearest adjacent edge of the light-sensitive photographic emulsion is detecting by said charge coupled device camera, said charge coupled device camera thereby generating an intensity signal; and, means for processing said intensity signal, said means for processing generating an output signal having a first amplitude corresponding to said support and a second amplitude corresponding to said emulsion, said first and second amplitudes being spatially separated by a juncture, said juncture defining said edge of said emulsion.

2. The apparatus recited in claim 1, wherein said angle of incidence is in the range from about 2 degrees to about 20 degrees.

3. The apparatus recited in claim 2, wherein said angle of incidence is 5 degrees.

4. The apparatus recited in claim 1, wherein said support is polyethylene coated paper.

5. An apparatus for detecting and centering a light-sensitive photographic emulsion on a movable and continuous support in the absence of visible light, said support having a first edge and a second edge with the light sensitive photographic emulsion coated thereon, said apparatus comprising:

a first collimated infrared light source for illuminating one of said first and second edges of the support and a nearest adjacent edge of said emulsion, wherein light waves emitted by said tint collimated infrared light source have a first, predetermined angle of inclination with a plane of the support less than about 20 degrees;

a first charge coupled device camera positioned above either of the first and second edge of said support;

a second collimated infrared light source for illuminating the other of said first and second edges of the support and said nearest adjacent edge of said emulsion, wherein light waves emitted by said second collimated infrared light source have a second, predetermined angle of inclination with said plane of support less than about 20 degrees;

a second charge coupled device camera positioned above the other of said first and second edges of the movable support;

wherein light scattered by the first edge of the support and said nearest adjacent edge of the emulsion is detected by said tint charge coupled device camera thereby defining a first differential edge width between said support and said emulsion; and, wherein light scattered by the second edge of the support and said nearest adjacent edge of the emulsion is detected by said second charge coupled device camera thereby defining a second differential edge width between said support and said emulsion; and means for generating a feedback signal corresponding to a difference between the first differential edge width and the second differential edge width between said support and said emulsion;

whereby any said difference between said first and second differential edge widths causes adjustment in said support until said first and second differential edge widths are substantially equal.

6. The apparatus recited in claim 5, wherein said first and second angles of incidence are each in the range from about 2 degrees to about 20 degrees.

7. The apparatus recited in claim 5, wherein said first and second angles of incidence each is 5 degrees.

8. The apparatus recited in claim 5, wherein said support is polyethylene coated paper.

* * * * *

UNITED STATES PATENT AND TRADEMARK OFFICE

CERTIFICATE OF CORRECTION

PATENT NO. : 5,679,161
DATED : 21 October 1997
INVENTOR(S) : John P. Wysokowski, et al It is certified that error appears in the above-indentified patent and that said Letters Patent is hereby corrected as shown below:

| | |
|---|---|
| Column 5, line 5 | change "detecting" to --detected-- |
| Column 5, line 33 | change "tint" to --first-- |
| Column 6, line 12 | change "tint" to --first-- |

Signed and Sealed this

Third Day of March, 1998

*Attest:*

Bruce Lehman

BRUCE LEHMAN

*Attesting Officer*

*Commissioner of Patents and Trademarks*